US007465384B2

(12) United States Patent
Levey et al.

(10) Patent No.: US 7,465,384 B2
(45) Date of Patent: Dec. 16, 2008

(54) ACID ELECTROLYTES

(75) Inventors: Peter R. Levey, Bellmore, NY (US); Neil D. Brown, Merrick, NY (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 136 days.

(21) Appl. No.: 11/364,665

(22) Filed: Feb. 28, 2006

(65) Prior Publication Data

US 2006/0191797 A1 Aug. 31, 2006

Related U.S. Application Data

(60) Provisional application No. 60/657,138, filed on Feb. 28, 2005.

(51) Int. Cl.

| | |
|---|---|
| ***C25D 7/06*** | (2006.01) |
| ***C25D 5/48*** | (2006.01) |
| ***C25D 5/50*** | (2006.01) |
| ***C25D 3/58*** | (2006.01) |
| ***C25D 3/60*** | (2006.01) |
| ***C25D 3/32*** | (2006.01) |

(52) U.S. Cl. ..... 205/140; 205/220; 205/226; 205/241; 205/252; 205/254; 205/302; 205/303

(58) Field of Classification Search ..... 106/1.25; 205/241, 252, 254, 300, 302, 303, 148, 140, 205/220, 226

See application file for complete search history.

(56) References Cited

U.S. PATENT DOCUMENTS

| | | | | |
|---|---|---|---|---|
| 4,482,596 A | | 11/1984 | Gulla et al. | 428/131 |
| 4,601,794 A | * | 7/1986 | Tsuda et al. | 205/130 |
| 4,657,632 A | | 4/1987 | Holtzman et al. | 156/659.1 |
| 4,715,894 A | | 12/1987 | Holtzman et al. | 106/1.22 |
| 4,816,070 A | | 3/1989 | Holtzman et al. | 106/122 |
| 4,882,202 A | | 11/1989 | Holtzman et al. | 427/98 |
| 4,883,740 A | | 11/1989 | Schwalm et al. | 430/270 |
| 5,124,175 A | * | 6/1992 | Miracky et al. | 216/13 |
| 5,160,422 A | | 11/1992 | Nishimura et al. | 205/254 |
| 5,196,053 A | | 3/1993 | Dodd et al. | 106/1.22 |
| 5,211,831 A | | 5/1993 | Vitale et al. | 205/85 |
| 5,248,527 A | | 9/1993 | Uchida et al. | 427/437 |
| 5,266,103 A | | 11/1993 | Uchida et al. | 106/122 |
| 5,587,063 A | | 12/1996 | Kuhm et al. | 205/173 |
| 5,814,202 A | | 9/1998 | Ilgar | 205/140 |

(Continued)

FOREIGN PATENT DOCUMENTS

EP 0 192 273 A1 8/1996

(Continued)

OTHER PUBLICATIONS

Merit Partnership Pollution Prevention Project for Metal Finishers, "Reducing Dragout with Spray Rinses", Jan. 1997, pp. 1-4.*

*Primary Examiner*—Edna Wong
(74) *Attorney, Agent, or Firm*—John J. Piskorski

(57) ABSTRACT

An acid electrolyte and method of using the electrolyte to both deposit tin and tin-alloys on iron containing substrates and at the same time perform as a flux to inhibit the formation of haze and stains on the tin and tin-alloys. The electrolytes and methods are suitable for plating on steel.

3 Claims, 2 Drawing Sheets

U.S. PATENT DOCUMENTS

| | | | | |
|---|---|---|---|---|
| 6,022,467 | A | 2/2000 | Ilgar | 205/140 |
| 6,030,516 | A | 2/2000 | O'Driscoll | 205/302 |
| 6,063,172 | A | 5/2000 | Bokisa et al. | 106/1.22 |
| 6,251,253 | B1 | 6/2001 | Gillman et al. | 205/239 |
| 6,508,927 | B2 * | 1/2003 | Yanada et al. | 205/241 |
| 6,607,653 | B1 * | 8/2003 | Tsuji et al. | 205/241 |
| 6,923,899 | B2 | 8/2005 | Brown et al. | 205/253 |

FOREIGN PATENT DOCUMENTS

| | | | | |
|---|---|---|---|---|
| EP | 1 342 817 | A2 | | 10/2003 |
| JP | 06010184 | A | * | 1/1994 |
| JP | 94346273 | A | | 12/1994 |
| JP | 11-152594 | | | 6/1999 |
| JP | 3481378 | B2 | | 12/2003 |
| WO | WO 98/13538 | A | | 4/1998 |

* cited by examiner

ACID ELECTROLYTES

BACKGROUND OF THE INVENTION

The present invention is directed to improved acid electrolytes for depositing tin and tin-alloys on iron containing substrates. More specifically, the present invention is directed to improved acid electrolytes for depositing tin and tin-alloys on iron containing substrates which are self-fluxing.

Iron containing substrates such as strip steel may be electroplated with tin in large continuous plating machines at steel mills throughout the world. In such machines a large coil of steel sheet unwinds at one end of the machine and proceeds through cleaning and acid pickling stations followed by multiple tin electroplating stations to produce a tin deposit over the steel surface. The tin coating, as plated, exhibits a characteristic smooth matte surface.

The next section of the line is a variously known as the "flow-melting", "flow-brightening", or "reflow" section. The reflow operation is used to transform the matte deposit to the bright reflective finish typical of tinplate and to produce a thin iron-tin compound layer at the interface between the tin coating and the steel base, thereby improving corrosion resistance. The operation includes the steps of raising the temperature of the tin coating to above the melting point of tin, followed by immediate quenching to impart and achieve the desired properties of the deposit.

In the reflow operation, after the matte tinplate is rinsed, the steel sheet proceeds through a fluxing station. The term "flux" in this context refers to a substance that aids, induces, or otherwise actively participates in fusing or flowing. The application of flux is followed by drying and the reflow station itself which raises the temperature of the steel to slightly above the melting point of tin. The steel is then quickly quenched in water, resulting in a tin surface that has a bright finish. After reflow, the steel proceeds through other stations for treatments such as passivation, oiling and rewinding or cutting into sections at the exit-end of the machine.

A uniform, bright finish is achieved without blemishes or discontinuities if all of the above steps are optimally executed. A flux treatment prior to reflow is important to prevent formation of tin oxides or hydroxides. The formation of tin oxides and hydroxides may cause defects in the tin finish during reflow. This defect is observable on the surface of the tin as a white haze. Another common defect is a blue haze caused by acid etching of the tin. Many desirable tin electrolytes include acids such as phenolsulfonic acid, sulfuric acid, fluoborate and alkyl sulfonic acids. A common alkyl sulfonic acid used in tin electrolytes is methane sulfonic acid. However, when a sufficient quantity of methane sulfonic acid is present in the flux by contamination due to improper rinsing before the flux, it causes a blue haze effect. Typically, methane sulfonic acid in amounts of 0.8 g/L and greater cause the blue haze effect. For this reason, the rinsing steps prior to fluxing are critical to quality. In order to prevent blue-haze, it has been found that one needs to achieve greater than 95% rinsing efficiency in methane sulfonic acid based electrolytes.

In an attempt to address the problem of the formation of tin oxides and hydroxides and acid etching of tin, steel articles plated with tin are rinsed with water in counter-flow rinsing systems to dilute any tin electrolyte on the plated steel and to remove residual acid. Such a system typically includes a number of consecutive isolated tanks in which water is sprayed onto the strip. Between the tanks, rubber snubber rolls prevent water from being passed from one tank to the next. De-ionized (DI) water is fed into the last tank and the tank is allowed to cascade back into the previous tank, with the first tank cascading back into the electrolyte. In such a system, the strip is thus washed in increasingly cleaner water and an optimum of rinsing efficiency with minimal water consumption can be realized. Each stage can achieve about 60% removal, thus a two stage system can achieve 84% removal and a 3-stage 94%. The counter-flow rinsing systems also recover any tin electrolyte which is lost to the environment as dragout from the tin plated steel. Such dragout, which contains the electrolyte components, may present a hazard to the environment if not recovered. The tin, any additional metals, acids and other electrolyte components typically are environmentally unfriendly. Additionally, recovery of most of the electrolyte increases the efficiency and reduces the cost of the tin deposition process to the industry.

A typical system includes at least three dragout cells filled with counter-flowing water and the last drag-out cell would double in function as the flux cell. The phenol sulfonic acid based electrolytes, such as phenol sulfonic acid (PSA) itself, performs the function of a flux and additional PSA is usually added to the final dragout cell. PSA is thus dragged out into quench water and incurs waste-water treatment costs as not only is PSA carcinogenic, but it also has a high chemical oxygen demand (COD), a measure of its environmental impact.

As sulfuric, fluoborate and methane sulfonic acid based electrolytes are not self-fluxing, a separate fluxing agent needs to be employed. Examples of fluxing agents are hydrochloric acid, phenolsulfonic acids, or an acid salt such as ammonium chloride and zinc chloride. However, a number of the typically used fluxing agents have problems. Hydrochloric acid may cause hazing of tin deposits. Phenolsulfonic acids are pollutants which can not be discharged into the environment. Significantly, none of these fluxing agents are compatible with the tin electrolyte and thus the fluxing cell (or final dragout cell) has to be isolated from the rest of the electrolyte. The electroplating electrolyte itself is not compatible with the fluxing agent and thus in order to achieve a defect free reflowed surface, one needs to perform optimal rinsing with typically more than four counter-flow dragout cells in conjunction with a separate fluxing cell. Thus at least 5 cells (4 rinse, 1 flux) in addition to the electroplating cells need to be used.

Most lines are built with PSA-based chemistry in mind and usually have only two to three cells in addition to the electroplating cells. Thus, if any PSA line is to be converted to a more environmentally friendly electrolyte, additional cells are installed. Due to the limited footprint and extensive machinery present on such lines, inserting additional cells is not a trivial undertaking. For this reason, such conversions, despite strong economic and environmental drivers, are not commonplace.

U.S. Pat. No. 5,427,677 to Mosher discloses a flux for reflowing tinplate. The flux includes non-poisonous and environmentally friendly naphthalenesulfonic compounds, and excludes the undesirable phenolsulfonic acids. Acids which may be included in the flux are hydrochloric acid, sulfuric acid, citric acid, alkane sulfonic acids such as methanesulfonic acid, alkanol sulfonic acids and ammonium chloride. The flux is suitable for removing tin oxide and hydroxide and for preventing blue haze formation. The flux is also employed in a separate fluxing cell, isolated from the tin electroplating electrolyte.

Although there are tin electrolytes and fluxes which prevent tin oxide and hydroxide formation and prevent acid etching, there is still a need for improved tin compositions which address such problems.

SUMMARY OF THE INVENTION

Compositions include one or more sources of tin ions, 30 g/L to 120 g/L of sulfuric acid, 0.1 g/L to 10 g/L of sulfosalicylic acid, salts or isomers thereof, one or more surfactants and one or more grain refiners. The compositions are self-fluxing electrolytes, which provide bright and uniform tin and tin-alloy deposits. The self-fluxing electrolytes prevent the formation of tin oxides and hydroxides on tin and tin-alloy deposits. They also prevent acid etching of tin and tin-alloy deposits, which typically is observable as a blue haze on the deposits. The compositions may further include one or more alloying components and optionally one or more additives to enhance the efficiency and quality of the deposit.

In another embodiment the compositions consist essentially of one or more sources of tin ions, 30 g/L to 120 g/L of sulfuric acid, 0.1 g/L to 10 g/L of sulfosalicylic acid, salts or isomers thereof, one or more surfactants, one or more grain refiners, and one or more reducing agents.

In a further embodiment a method includes depositing a tin or tin-alloy on an iron containing substrate; and rinsing the iron containing substrate with the deposited tin or tin-alloy in a composition including sulfosalicylic acid, salts or isomers thereof.

In an additional embodiment a method includes depositing tin or tin-alloy from an acid electrolyte including sulfuric acid and sulfosalicylic acid, salts or isomers thereof on an iron containing substrate; rinsing the iron containing substrate with the deposited tin or tin-alloy in a composition including sulfosalicylic acid, salts or isomers thereof; drying the iron containing substrate with the tin or tin-alloy deposit; and reflow melting the deposit. After reflow the strip is quenched in DI water, exposed to a chromic acid solution for passivation, rinsed, dried, oiled and re-coiled or cut into sheets.

The compositions and methods may be used to deposit tin and tin-alloys from an acid electrolyte including sulfuric acid and sulfosalicylic acid, salts or isomers thereof on any suitable iron containing substrate. Such iron containing substrates typically are steel. The steel may be in the form of rods, bars, sheets, strips, wire and wool.

DETAILED DESCRIPTION OF THE INVENTION

Figure 1:
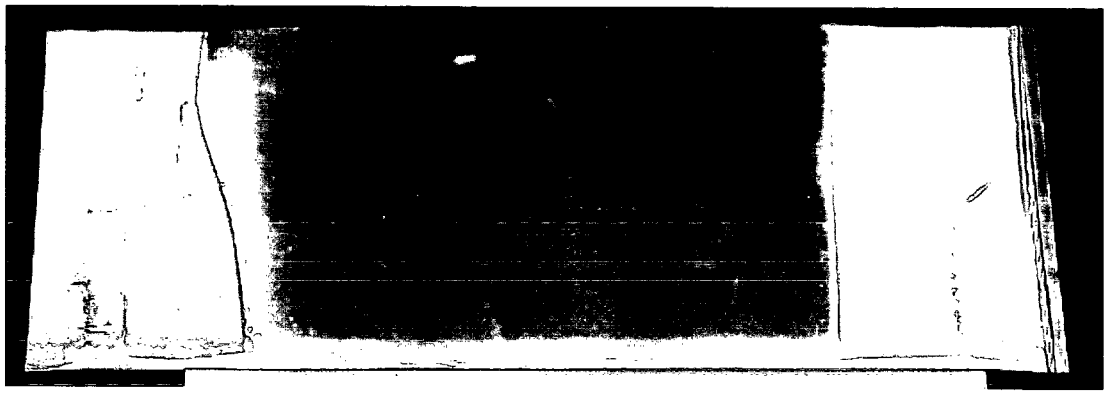
FIG. 1 is a photograph of a haze free tin film on a steel coupon plated with a self-fluxing sulfuric acid/sulfosalicylic acid electrolyte and treated with a 90% diluted version of the self-fluxing electrolyte before being reflow melted.

As used throughout this specification, the following abbreviations shall have the following meanings, unless the context clearly indicates otherwise: ° C.=degrees Centigrade; g=gram; L=liter; ml=milliliter; cm=centimeter; dm=decimeter; A=amps; Dalton=1/12 the mass of an atom of carbon−12=$1.661\times10^{-21}$ g; and wt %=percent by weight. The terms "depositing" and "plating" are used interchangeably throughout this specification. "Halide" refers to fluoride, chloride, bromide and iodide. "Alkyl" refers to linear, branched and cyclic alkyl. All percentages are by weight, unless otherwise noted. All numerical ranges are inclusive and combinable in any order, except where it is logical that such numerical ranges are constrained to add up to 100%.

The compositions include one or more sources of tin ions, 30 g/L to 120 g/L of sulfuric acid, 01. g/L to 10 g/L of sulfosalicylic acid, salts or isomers thereof, and one or more surfactants. The compositions may further include one or more alloying components, and one or more additives to enhance the efficiency and quality or the deposit. The compositions are self-fluxing electrolytes, which provide bright and uniform tin and tin-alloy deposits. The self-fluxing electrolytes prevent formation of tin oxides and hydroxides on tin and tin-alloy deposits. They also prevent acid etching of tin and tin-alloy deposits, which typically is observable as a blue haze.

The one or more sources of tin useful in the compositions are any soluble tin compound. Suitable tin compounds are chosen from, but are not limited to, tin salts, such as tin sulfates, tin halides, tin alkane sulfonates such as tin methane sulfonate, tin ethane sulfonate, and tin propane sulfonate, tin aryl sulfonate such as tin phenyl sulfonate and tin toluene sulfonate, and tin alkanol sulfonate. Mixtures of the various tin salts also may be used in the compositions. Typically tin sulfate is used in the compositions. When tin halide is used, the halide is typically chloride. The tin compounds useful in the compositions are generally commercially available from a variety of sources and may be used without further purification. Alternatively, the tin compounds may be prepared by methods known in the literature.

The amount of tin compounds used in the compositions is any amount that provides a tin content in the range of 5 g/L to 100 g/L, or such as from 5 g/L to 60 g/L, or such as from 8 g/L to 30 g/L. When the compositions are used in a low speed plating process, the amount of tin in the composition is in the range of 5 g/L to 60 g/L or such as from 10 g/L to 30 g/L. When the compositions are used in high speed tin plating, the amount of tin is from 5 g/L to 40 g/L or such as from 8 g/L to 20 g/L.

Acids used in the compositions are the inorganic acid sulfuric acid and the organic acid sulfosalicylic acid, its salts and isomers. Sulfuric acid is the base acid for the composition. It is used in amounts of 30 g/L to 120 g/L, or such as from 35 g/L to 100 g/L, or such as from 40 g/L to 90 g/L, or such as from 50 g/L to 70 g/L. Sulfosalicylic acid is used in amounts of 0.1 gm/L to 10 g/L, or such as from 0.5 g/L to 8 g/L, or such as from 1 g/L to 5 g/L. The sulfosalicylic acid, its salts and isomers act as fluxing agents and transforms the sulfuric acid-based electrolyte into a self-fluxing composition. Other acids are typically excluded from the compositions since they may cause the undesired formation of tin oxide, tin hydroxides and the blue haze.

The compositions also include one or more surfactants. Any suitable surfactant which may be employed in tin and tin-alloy deposition of iron containing substrates may be used. Such surfactants include non-ionic surfactants, anionic surfactants, cationic surfactants and amphoteric surfactants. Typically, the compositions include one or more non-ionic surfactants. Generally, surfactants are included in the compositions in amounts of 0.1 g/L to 30 g/L, or such as from 0.5 g/l to 20 g/L, or such as from 1 g/l to 10 g/L.

Examples of suitable non-ionic surfactants include alkylene oxide compounds. Suitable alkylene oxide compounds include, but are not limited to, ethylene oxide/propylene oxide ("EO/PO") copolymers, alkylene oxide condensation products of an organic compound having at least one hydroxy group and 20 carbon atoms or less, and compounds prepared by adding oxypropylene to polyoxyethylene glycol. Typically, the EO/PO copolymers have an average molecular weight in the range of from 500 to 10,000 Daltons, or such as from 1000 to 5000 Daltons. Most typically, the alkylene oxide compound is an EO/PO copolymer. Such alkylene oxide compounds are present in the electrolyte compositions in an amount of 0.1 g/L to 20 g/L, or such as from 0.5 g/L to 10 g/L.

Suitable alkylene oxide condensation products of an organic compound having at least one hydroxy group and 20 carbon atoms or less include those having an aliphatic hydrocarbon of from one to seven carbon atoms, an unsubstituted aromatic compound or an alkylated aromatic compound having six carbons or less in the alkyl moiety, such as those disclosed in U.S. Pat. No. 5,174,887. The aliphatic alcohols may be saturated or unsaturated. Suitable aromatic compounds are those having up to two aromatic rings. The aromatic alcohols have up to 20 carbon atoms prior to derivatization with ethylene oxide. Such aliphatic and aromatic alcohols may be further substituted, such as with sulfate or sulfonate groups. Such suitable alkylene oxide compounds include, but are not limited to: ethoxylated polystyrenated phenol having 12 moles of EO, ethoxylated butanol having 5 moles of EO, ethoxylated butanol having 16 moles of EO, ethoxylated butanol having 8 moles of EO, ethoxylated octanol having 12 moles of EO, ethoxylated beta-naphthol having 13 moles of EO, ethoxylated bisphenol A having 10 moles of EO, ethoxylated sulfated bisphenol A having 30 moles of EO and ethoxylated bisphenol A having 8 moles of EO.

Other suitable non-ionic surfactants include polyalkylene glycols. Suitable polyalkylene glycols include, but are not limited to, polyethylene glycol, and polypropylene glycol. Such polyalkylene glycols are generally commercially available from a variety of sources and may be used without further purification.

Typically, the polyalkylene glycols useful in the compositions are those having an average molecular weight in the range of 200 to 100,000 Daltons or such as from 900 to 20,000 Daltons. Such polyalkylene glycols are present in the electrolyte compositions in an amount of 0.1 g/L to 15 g/L, or such as from 0.25 g/L to 10 g/L, or such as from 0.5 g/L to 8 g/L.

Any suitable compound which provides grain refinement of tin and tin-alloy deposits on iron containing substrates may be used. Grain refiners are included in the compositions in amounts of 0.01 g/L to 20 g/L, or such as from 0.5 g/L to 8 g/L, or such as from 1 g/L to 5 g/L. Such grain refiners include, but are not limited to, carboxy aromatic compounds. Such compounds further improve the deposit appearance and operating current density range. A wide variety of such carboxy aromatic compounds are well know to those of skill in the art, such as picolinic acid, nicotinic acid, and isonicotinic acid. Other suitable grain refiners include alkoxylates, such as the polyethoxylated amines sold under the tradenames of JEFFAMINE™ T-403, available from Huntsman Corporation, or TRITON™ RW, or sulfated alkyl ethoxylates, such as those sold under the tradenames TRITON™ QS-15, and gelatin and gelatin derivatives. Certain surfactants or combination of surfactants may also operate as grain refiners.

One or more other metals may be added to the composition for depositing tin-alloys. Suitable alloying metals include, but are not limited to, copper, nickel, bismuth, zinc, silver, indium and mixtures thereof. Typically copper or nickel are used. Most typically copper is used as the alloying metal with tin. Such alloying metal compounds useful in the compositions are any which provide the metal to the composition in a soluble form. Other metal compounds include, but are not limited to, salts such as metal halides, metal sulfates, metal alkane sulfonates such as metal methane sulfonate, metal aryl sulfonates such as metal phenyl sulfonate and metal toluene sulfonate, and metal alkanol sulfonates. Typically, metal sulfates are used. Mixtures of the salts also may be included in the compositions.

The choice of the other metal compounds and the amount of such other metal compounds present in the composition depends upon the tin-alloy to be deposited. Such amounts are well know to those of skill in the art. For example, when copper is present, it is typically used in an amount of 0.01 g/L to 10 g/L, or such as from 0.02 g/L to 5 g/L. When the compositions are used in a non-high speed deposition process, the amount of copper in the electrolyte composition is in the range of 0.01 g/L to 5 g/L, or such as from 0.02 g/L to 2 g/L. When such compositions are used in high speed deposition processes, the amount of copper present in the electrolyte composition is in the range of 0.5 g/L to 10 g/L, or such as 0.5 g/L to 5 g/L. Mixtures of copper compounds may be used.

One or more other additives may be included in the compositions such as reducing agents, wetting agents, brightening agents, compounds which extend the current density range, such as carboxylic acids, and sludge agglomerants. Mixtures of such additives also may be included in the electrolyte compositions. Such optional additives may be used in conventional amounts.

Reducing agents may be added to the electrolyte compositions to assist in keeping the tin in a soluble divalent state. The amount of reducing agents is well known to those of skill in the art, but typically is in the range of 0.1 g/L to 10 g/L, or such as from 1 g/L to 5 g/L. Suitable reducing agents include, but are not limited to, hydroquinone and hydroxylated aromatic compounds, such as 1,2,3-trihydroxybenzene, 1,2-dihydroxybenzene, 1,2-dihydroxybenzene-4-sulfonic acid, 1,2-dihydroxybenzene-3,5-disulfonic acid, 1,4-dihydroxybenzene, 1,4-dihydroxybenzene-2-sulfonic acid, 1,4-dihydroxybenzene-2,5-disulfonic acid, 2,4-dihyroxybenzene sulfonic acid, resorcinol and catechol. Such reducing agents are disclosed in U.S. Pat. No. 3,749,649 and U.S. Pat. No. 4,871,429.

Other suitable reducing agents include transition metals selected from the elements of Group IVB, VB and VIB of the Periodic Table of Elements. Suitable compounds include, but are not limited to, vanadium compounds whose valences are $5^+$, $4^+$, $3^+$ and $2^+$. Examples of useful vanadium compounds are vanadium pentoxide, vanadium sulfate, vanadyl (IV) acetyl-acetonate and sodium vanadate.

Bright deposits may be obtained by adding brighteners to the electrolyte compositions. Such brighteners are well known to those of skill in the art. Suitable brighteners include, but are not limited to, aromatic aldehydes such as chlorobenzaldehyde, derivatives of aromatic aldehydes such as benzal acetone, and aliphatic aldehydes such as acetaldehyde and glutaraldehyde. Such brighteners are added to the compositions to improve the appearance and reflectivity of the deposit. Brighteners are included in the compositions in amounts of 0.5 g/L to 3 g/L or such as 1 g/l to 2 g/L.

In addition to the components added when formulating the compositions, the compositions may also include iron. The iron may accumulate in the compositions during plating and rinsing of iron containing substrates. Iron may range in amounts of 0.1 g/L to 40 g/L, or such as from 5 g/L to 30 g/l, or such as from 10 g/l to 20 g/L.

Thus, another embodiment includes compositions consisting essentially of one or more sources of tin ions, 30 g/L to 120 g/L of sulfuric acid, 0.1 g/L to 10 g/L of sulfosalicylic acid, its salts or isomers, one or more surfactants, and one or more of the other additives.

The compositions may be prepared by any suitable method know in the art. Typically, they are prepared by adding to a vessel sulfuric acid, sulfosalicylic acid followed by one or more tin compounds, one or more surfactants, one or more grain refiners and any other optional components. Water also may be added to the compositions. Other orders of addition of the components of the compositions may be used. Once the composition is prepared, any undesired material is removed, such as by filtration, and then water is added to adjust the final volume of the composition. The composition may be agitated by any known means, such as stirring, pumping, sparging or jetting the composition, for increased deposition speed.

The electrolyte compositions typically are acidic with a pH of less than 7, or such as less than 1 to 4, or such as less than 1 to 2.

In a further embodiment, the compositions are used to deposit a tin or tin-alloy on an iron containing substrate, followed by rinsing the tin or tin-alloy deposit with a dilute composition containing the fluxing agent used in the electrolyte composition with which the substrate was plated to inhibit formation of tin oxides, tin hydroxides and blue stains. Rinsing is performed at temperatures of 40° C. to 100° C., or such as from 60° C. to 95° C. The rinse following the tin or tin-alloy deposition removes residual components of the plating electrolyte composition from the substrate. The rinse solution is recovered and then recycled back to the electrolyte composition for tin or tin-alloy deposition. The electrolyte composition performs a dual function. It is used to deposit tin or tin-alloys on the substrate and at the same time performs as a flux to inhibit formation of the tin oxides and hydroxides and also inhibits acid etching.

After rinsing with the dilute fluxing composition, the tin or tin-alloy deposit is typically reflowed by conduction or induction heating. Tin and tin-alloys may be reflowed at temperatures of 235° C. to 400° C., or such as from 240° C. to 280° C. Such reflow methods and conduction and induction heaters are well known in the art. After the tin or tin-alloy has been reflowed, the substrate with the deposit can be further processed using conventional methods.

Any suitable plating method may be used to deposit the tin or tin-alloy. Suitable plating methods include, but are not limited to, barrel plating, rack plating and reel-to-reel high speed plating. A tin or tin-alloy deposit may be plated on a substrate by the steps of contacting the substrate with the electrolyte composition described above and passing a current through the electrolyte to deposit the tin or tin-alloy on the substrate. Substrates plated with the tin or tin-alloy electrolyte compositions contain iron. Such iron containing substrates include steel. Typically, the steel is low carbon steel. Low carbon steel contains from 0.02% to 0.3% carbon.

The substrate to be plated may be contacted with the electrolyte composition in any suitable manner know in the art. Typically, the substrate is placed in a bath containing the electrolyte composition. In an alternative embodiment, the compositions may be sprayed or flood coated on the substrate.

Current density used to plate the tin or tin-alloy is in the range of, but not limited to, 0.1 A/dm$^2$ to 200 A/dm$^2$. When a low speed electroplating process is used, the current density is in the range of 0.1 A/dm$^2$ to 4 A/dm$^2$ or such as 0.1 A/dm$^2$ to 3 A/dm$^2$. When a high speed electroplating process is used, the current density is in the range of 5 A/dm$^2$ to 200 A/dm$^2$ or such as from 10 A/dm$^2$ to 150 A/dm$^2$.

The tin and tin-alloy of the compositions may be deposited at a temperature in the range of, but not limited to, 15° C. to 70° C., or such as from 20° C. to 60°, or such as from 30° C.

High speed electroplating processes may be performed using any of a variety of high speed electroplating equipment. Such high speed electroplating equipment is well known to those skilled in the art, such as, for example, that disclosed in U.S. Pat. No. 3,819,502.

In continuous counter-flow systems for depositing tin and tin-alloys on iron containing substrates, the substrates are first passed into one or more plating cells containing the tin or tin-alloy electrolyte composition. As each substrate passes through each plating cell, tin or tin-alloy is deposited on the substrate. The thickness of the deposit varies depending on the amount of time it takes the substrate to pass through the plating cells. Generally, the slower the rate of passage, the thicker the deposit. The substrate then passes into one or more dragout cells which contain the electrolyte composition at diluted concentrations. As the substrate passes from one dragout cell to the next, the concentration of the electrolyte components becomes more dilute. Typically, the electrolyte is at concentrations of 5 wt % to 25 wt %, or such as from 10 wt % to 20 wt %, or such as from 10 wt % to 15 wt % of the electrolyte composition in the plating cells. The number of cells typically is from one to three. More typically the number of cells is two. The last dragout cell in the system is called the flux cell. Typically, the flux cell contains the electrolyte at its lowest concentration. Additional fluxing agent may be added directly to the fluxing cell, depending on the efficiency of the rinses prior to the fluxing cell.

The flow of electrolyte in the system is continuous. Electrolyte in the plating cells flows from each plating cell to a recirculation tank which passes the electrolyte at its plating concentrations back to the plating cells. Excess water accumulated in the recirculation tank is passed into an evaporator where it is evaporated with a fraction returning to the recirculation tank. Electrolyte from the dragout cells counter-flows from the flux cell back to the other dragout cells. As the substrate passes from the plating cells to the dragout cells, the dilute counter-flowing electrolyte rinses the substrate of plating electrolyte and simultaneously prepares the substrate for reflow melting. An outside source of water flows from the last dragout cell toward the first cell to keep the flow in the dragout cells counter to the incoming substrate. Components of the electrolyte rinsed from the substrate are reclaimed in the dragout cells and then passed from the cells to the recirculation tank where the electrolyte components are returned to the plating electrolyte and reused to plate additional substrates. Accordingly, most of the electrolyte is reused and waste is minimal. Additionally, since the electrolyte used for tin and tin-alloy deposition and that portion used as the rinse include the fluxing agent, the substrate is continuously being fluxed, thus continuously inhibiting tin oxide and hydroxide formation as well as acid etching.

Further, the electrolyte compositions include sulfuric acid as a base. Without being limited by the theory, this acid is sufficiently volatile such that enough vaporizes in the process to eliminate or reduce the potential for it to etch the deposit or residual amounts of it do not cause an etching of the tin substrate. Additionally, the inclusion of the flux agent has been observed to counteract some of the etching action of the acid. The electrolyte compositions typically exclude acids such a hydrochloric acid and alkyl sulfonic acids, which readily etch the deposits. Alkyl sulfonic acids, such as methane sulfonic acid, are more prone to etching the deposit and require at least 4 rinsing tanks and a separate fluxing tank. In contrast the present method may use a total of two rinsing/ fluxing tanks. PSA-based electrolytes similarly only require a minimum of two rinse/flux tanks, but the environmental impact of the PSA make these electrolyte bases undesirable. Thus, the present compositions and methods are an improvement over many conventional tin and tin-alloy plating compositions and methods.

After the substrate with the tin or tin-alloy deposit is rinsed and fluxed, it is dried. It can be dried by any suitable method, such as dried at room temperature or hot-air dried. The tin or tin-alloy deposit is then reflowed by induction or conduction heating. This develops an $FeSn_2$ alloy layer and the tinplate product then displays improved tin adhesion, corrosion resistance and a bright finish which is attractive from a cosmetic standpoint. Such methods are well known in the art. The substrate may then be further processed using conventional methods practiced in the industry.

EXAMPLE 1

10 wt % Flux with Sulfuric Acid and Sulfosalicylic Acid

A 6 cm×15 cm steel coupon was plated with tin using an acid electrolyte which included 20 g/L of tin from tin sulfate, 40 g/L of sulfuric acid, 7 g/L of 5-sulfosalicylic acid, 0.5 g/L of an EO/PO copolymer having an average molecular weight of 2200, and 10 ml/L of a sulfated alkyl ethoxylate (TRITON™ QS-15). The acid electrolyte also included residual iron in an amount of 10 g/L. Water was added to the electrolyte to provide the desired volume. The pH of the electrolyte was less than 1.

The steel coupon was wrapped around a conductive mandrel and rotated at a speed of 1500 rpm in the acid electrolyte at a temperature of 30° C. The coupon was then electroplated using a current density of 30 A/dm$^2$ to deposit a tin coating $1\times10^{-4}$ cm thick.

The steel coupon with the tin deposit was then placed into a 10 wt % aqueous flux solution containing 2 g/L of tin, 4 g/L of sulfuric acid, 0.7 g/L of 5-sulfosalicylic acid, 0.05 g/L of the EO/PO copolymer and 1 ml/L of the sulfated alkyl ethoxylate for 5 seconds at 90° C. to simulate a final dragout solution. The coupon was removed from the flux solution and air dried at room temperature. After air drying the coupon was conduction-reflow melted by passing sufficient electric current through the panel to cause the temperature to exceed 232° C. within 15 seconds.

FIG. 1 is a photograph of the melted tin on the steel coupon taken with a Nikon Coolpix™ 995 digital camera. The dark portion of the photograph is the melted tin. As the photograph shows the tin is uniform in appearance with no white haze caused by tin oxides or tin hydroxides. Further, there was no blue color present on the tin indicating acid etching.

EXAMPLE 2

15 wt % Flux with Sulfuric Acid and Sulfosalicylic Acid

A second steel coupon having the dimensions of 6 cm×15 cm was plated with the acid electrolyte as described in Example 1. The steel coupon was wrapped around a mandrel and rotated at a speed of 1500 rpm. The current density during tin deposition was 30 A/dm$^2$ and the temperature of the electrolyte was 30° C. The tin film formed on the steel coupon was $1\times10^{-4}$ cm thick.

The steel coupon was then placed in a 15 wt % aqueous flux solution for 5 seconds. The solution was composed of 3 gm/L of tin ions, 6 g/L of sulfuric acid, 1 g/L of 5-sulfosalicylic acid, 0.07 g/L of the EO/PO copolymer, 1.5 ml/L of the sulfated alky ethoxylate and iron residues in an amount of 1.5 gm/L. The flux solution was at 90° C.

After treating the steel coupon in the 15% flux, it was air dried at room temperature and conduction-reflow as in Example 1. The melted tin appeared substantially the same as the tin in FIG. 1. The tin showed no observable white haze or blue color.

EXAMPLE 3

20 wt % Flux with Sulfuric acid and Sulfosalicylic Acid

A third 6 cm×15 cm steel coupon was electroplated with tin using the acid electrolyte of Example 1. The steel coupon was wrapped around a mandrel and rotated at a speed of 1500 rpm in the electrolyte at a temperature of 30° C. The current density was 30 A/dm$^2$. The tin formed a film on the steel coupon $1\times10^{-4}$ cm thick.

The steel coupon was then placed in a 20 wt % aqueous flux composition for 5 seconds. The flux composition included 4 g/L of tin ions, 8 g/L of sulfuric acid, 1.5 g/L of 5-sulfosalicylic acid, 0.1 g/L of the EO/PO copolymer, 2 ml/L of the sulfated alky ethoxylate and 2 g/L of iron. The solution was at 90° C.

The coupon was then air dried at room temperature and then conduction-reflow melted as in Example 1. The tin on the coupon showed no observable white haze or blue color.

EXAMPLE 4

Deionized Water Rinse

An electrolyte composition was prepared containing 7 g/L of tin from tin sulfate, 40 g/L of sulfuric acid, 0.1 g/L of an EO/PO copolymer having an average molecular weight of 2200, 0.5 ml/L of a sulfated alky ethoxylate (TRINTON™ QS-15) and 1 g/L of hydroquinone. A sufficient amount of water was added to the electrolyte to provide the desired volume. The pH of the electrolyte was less than 1.

A steel coupon with the dimensions of 6 cm×15 cm was wrapped around a conductive mandrel and rotated at a speed of 1500 rpm in the electrolyte at a temperature of 30° C. The coupon was then electroplated using a current density of 30 A/dm$^2$ to deposit a tin film on the steel coupon $1\times10^{-4}$ cm thick. The tin plated steel coupon was then rinsed with deionized water for 5 seconds. No fluxing agent was included in the deionized water rinse. After rinsing the rinsed coupon was conduction-reflow melted as in Example 1.

Figure 2:
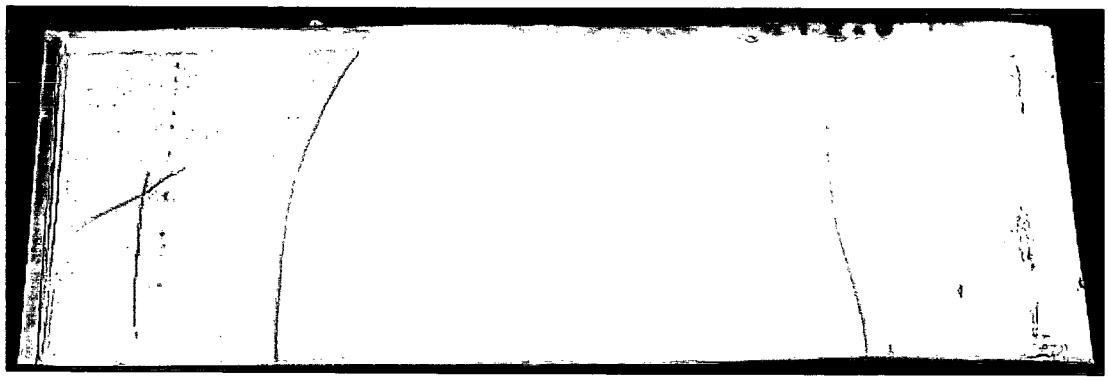
FIG. 2 is a photograph of a hazy tin film on a steel coupon plated with a sulfuric acid tin electrolyte and rinsed with water.

FIG. 2 is a photograph of the coupon with the melted tin film. The photograph shows white haze caused by the formation of tin oxides and tin hydroxides. In contrast, FIG. 1, which shows the tin film plated with a tin electrolyte and treated with the fluxing electrolyte which contained sulfuric acid and 5-sulfosalicylic acid, shows no undesirable white haze.

EXAMPLE 5

0.1 wt % HCl flux

An electrolyte composition was prepared containing 20 g/L of tin from tin chloride, 40 g/L of HCl, 1 g/L of an EO/PO copolymer with an average molecular weight of 1500, and 0.5 ml/L of an sulfated alkyl ethoxylate (TRITON™ QS-15). Sufficient water was added to the bath to provide the desired volume.

A steel coupon having the dimensions 6 cm×15 cm was wrapped around a conductive mandrel and rotated at a speed of 1200 rpm in the electrolyte at a temperature of 30° C. The coupon was then electroplated using a current density of 30 A/dm$^2$ to deposit a tin film having a thickness of $1\times10^{-4}$ cm. The panel was then placed in a flux solution for 5 seconds. The flux solution included 0.02 g/L of tin, 0.04 g/L of HCl, 0.001 g/L of the EO/PO copolymer, 0.0005 ml/L of the sulfated alkyl ethoxylate, and 0.01 gm/L of iron.

Figure 3:
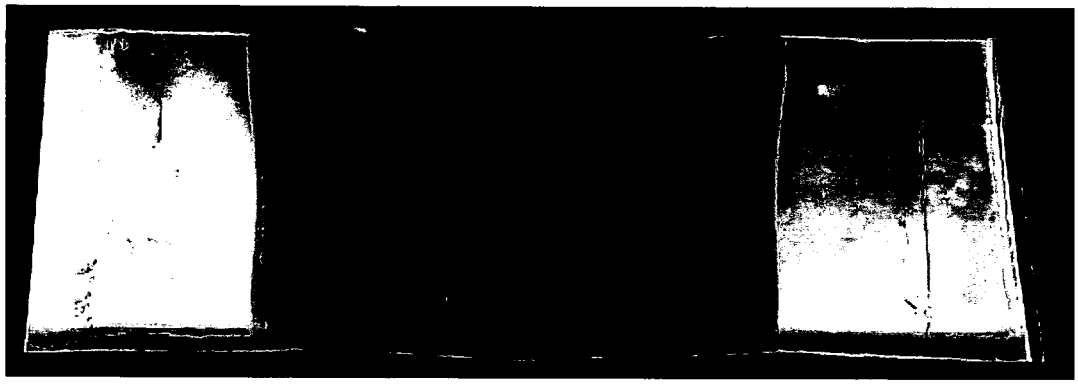
FIG. 3 is a photograph of a hazy tin film on a steel coupon plated with a methane sulfonic acid tin plating electrolyte and fluxed with a 0.1% hydrochloric acid flux.

After the steel coupon was removed from the flux composition, it was air dried at room temperature. The coupon was then conduction-reflow melted as in Example 1. FIG. 3 is a photograph of the coupon treated with the 0.1 wt % HCl flux. Although the tin in FIG. 3 has less white haze in comparison to that of FIG. 2, the tin film in FIG. 1 is noticeably better than the tin films shown in FIGS. 2 and 3. The electrolyte and flux of Example 1 is an improvement over the compositions of Examples 4 and 5.

EXAMPLE 6

Sulfosalicylic acid Flux with Methane Sulfonic Acid

An electrolyte composition was prepared containing 20 g/L of tin from tin methane sulfonate, 5 g/L of free methane sulfonic acid, 2 g/L of an EO/PO copolymer with an average molecular weight of 2000, and 15 ml/L of TRITON QS-15. Water was added to the electrolyte to bring it to a desired volume.

A steel coupon having the dimensions 6 cm×15 cm was wrapped around a conductive mandrel and rotated at a speed of 1500 rpm in the electrolyte at a temperature of 30° C. The coupon was plated at a current density of 30 A/dm$^2$ to provide a tin film on the coupon with a thickness of $1\times10^{-4}$ cm.

The tin plated coupon was then placed in an aqueous flux solution for 5 seconds. The solution included 5 g/L methane sulfonic acid and 0.5 g/L of 5-sulfosalicyclic acid. The temperature of the flux was 90° C. The coupon was then dried at room temperature and conduction oven and conduction-reflow melted as in Example 1.

Figure 4:
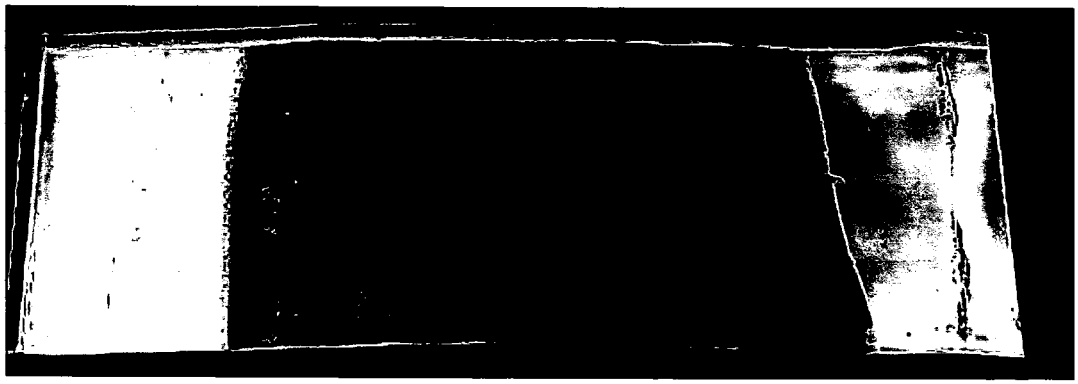
FIG. 4 is a photograph of a blue stained tin film on a steel coupon treated with a sulfosalicylic acid flux contaminated with methane sulfonic acid.

FIG. 4 is a photograph of the tin after reflow. The photograph has a rough appearance due to blue stains caused by the etching action of methane sulfonic acid. In contrast, FIG. 1, which was tin plated with an electrolyte and treated with a flux which included sulfuric acid and s-sulfosalicylic acid shows a clean unstained surface.

EXAMPLE 7

Tin/Copper Alloy Electrolyte and 5 wt % Flux

A 6 cm×15 cm steel coupon is plated with a tin/copper alloy acid electrolyte which included 30 g/L of tin ions from tin sulfate, 20 g/L of copper ions from copper sulfate pentahydrate, 50 g/L of sulfuric acid, 10 g/L of 5-sulfosalicylic acid, 1 g/L of an EO/PO copolymer having an average molecular weight of 3000, and 20 ml/L of a polyethoxylated amine (JEFFAMINE™ T-403, available from Huntsman Corporation). Water is included in the electrolyte to provide a desired volume. The pH of the electrolyte is 1.

The steel coupon is wrapped around a conductive mandrel and rotated at a speed of 1200 rpm in the acid electrolyte at a temperature of 30° C. The coupon is electroplated using a current density of 20 A/dm$^2$ to deposit a tin/copper alloy film on the coupon having a thickness of $2\times10^{-4}$ cm.

The steel coupon with the tin/copper film is then placed into a 5 wt % aqueous flux for 10 seconds at 95° C. The flux contains 1.5 g/L of tin ions, 1 g/L of copper ions, 2.5 g/L of sulfuric acid, 0.5 g/L of 5-sulfosalicylic acid, 0.05 g/L of the EO/PO copolymer and 1 ml/L of the polyethoxylated amine. The coupon is then removed from the flux and air dried at room temperature. After air drying the coupon is conduction-reflow melted as in Example 1. The melted tin/copper alloy film is expected to be free of any white and blue stains and have an appearance substantially as that of FIG. 1.

EXAMPLE 8

Tin/Nickel Electrolyte and 10 wt % Flux

A 6 cm×15 cm steel coupon is plated with a tin/nickel alloy using an acid electrolyte which includes 10 g/L of tin from tin sulfate, 10 g/L of nickel from nickel sulfate, 50 g/L of sulfuric acid, 5 g/L of 5-sulfosalicylic acid, 2 g/L of an EO/PO copolymer having an average molecular weight of 1000, and 5 ml/L of a polyethoxylated amine (JEFFAMINE™ T-403). Water is added to the electrolyte to provide a desired volume. The pH of the electrolyte is 1.

The steel coupon is wrapped around a conductive mandrel and rotated at a speed of 1600 rpm in the acid electrolyte at a temperature of 30° C. The coupon is then electroplated using a current density of 25 A/dm$^2$ to deposit a tin/nickel film $5\times10^{-5}$ cm thick.

The steel coupon with the tin/nickel deposit is then placed into a 10 wt % aqueous flux solution containing 1 g/L of tin, 1 g/L of nickel, 5 g/L of sulfuric acid, 0.5 g/L of 5-sulfosalicylic acid, 0.2 g/L of the EO/PO copolymer and 0.5 ml/L of the polyethoxylated amine for 5 seconds at 95° C. to simulate a final dragout solution. The coupon is removed from the flux solution and air dried at room temperature. After air drying the coupon is conduction-reflow melted as in Example 1. The reflow tin/nickel alloy is expected to be free of haze and blue stains as shown in FIG. 1.

EXAMPLE 9

Tin/Nickel/Copper Alloy and 20 wt % Flux

A 6 cm×15 cm steel coupon is plated with tin/nickel/copper alloy using an acid electrolyte which included 5 g/L of tin from tin sulfate, 5 g/L of nickel from nickel sulfate, 5 g/L of copper from copper sulfate pentahydrate, 100 g/L of sulfuric acid, 10 g/L of 5-sulfosalicylic acid, 1 g/L of an EO/PO copolymer having an average molecular weight of 1500, and 15 ml/L of a sulfated alkyl ethoxylate (TRITON™ QS-15). The electrolyte also includes residual iron in an amount of 5 g/L. Water is added to the electrolyte to provide a desired volume. The pH of the electrolyte is 1.

The steel coupon is wrapped around a conductive mandrel and rotated at a speed of 1200 rpm in the acid electrolyte at a temperature of 25° C. The coupon is then electroplated using a current density of 15 A/dm$^2$ to deposit a tin/nickel/copper alloy film on the coupon with a thickness of $2\times10^{-4}$ cm.

The coupon with the alloy film is then placed into a 20 wt % flux solution for 10 seconds. The flux solution included 1 g/L of tin, 1 g/l of nickel, 1 g/L of copper, 20 g/L of sulfuric acid, 2 g/L of 5-sulfosalicylic acid, 0.2 g/L of the EO/PO copolymer and 3 ml/L of the sulfated alkyl ethoxylate. The temperature of the flux solution is 95° C.

The alloy coated coupon is then removed from the flux solution, air dried and then conduction-reflow melted as in Example 1. The alloy is expected to be free of haze and blue stains.

EXAMPLE 10

Tin/Bismuth Alloy and 5 wt % Flux

A 6 cm×15 cm steel coupon is plated with a tin/bismuth alloy using an acid electrolyte which includes 25 g/L of tin from tin sulfate, 10 g/L of bismuth from bismuth trichloride, 90 g/L of sulfuric acid, 10 g/L of 5-sulfosalicylic acid, 2 g/L of an EO/PO copolymer with an average molecular weight of 2500, and 10 ml/L of a sulfated alkyl ethoxylate (TRITON™ QS-15). Water is added to the electrolyte to provide a desired volume. The pH of the electrolyte is less than 1.

The steel coupon is wrapped around a conductive mandrel and rotated at a speed of 1300 rpm in the acid electrolyte at a temperature of 30° C. The coupon is electroplated using a current density of 10 A/dm$^2$ to deposit a tin/bismuth alloy film on the coupon having a thickness of $1\times10^{-4}$ cm.

The steel coupon with the alloy film is then placed in a 5 wt % flux solution for 5 seconds. The flux solution includes 1.25 g/L of tin, 0.5 g/L of bismuth, 4.5 g/L of sulfuric acid, 0.5 g/L of 5-sulfosalicylic acid, 0.1 g/L of the EO/PO copolymer, and 0.5 ml/L of TRITON™ QS-15. The coupon is removed from the flux solution and air dried. The alloy is then conduction-reflow melted as in Example 1. The reflow melted alloy is expected to be free of haze and blue stains.

EXAMPLE 11

Tin/Indium Alloy and 15 wt % Flux

A 6 cm×15 cm steel coupon is plated with a tin/indium alloy using an acid electrolyte which includes 35 g/L of tin from tin sulfate, 5 g/L of indium trichloride, 50 g/L of sulfuric acid, 1 gm/L of 5-sulfosalicylic acid, 1 g/L of an EO/PO copolymer with an average molecular weight of 5000, and 10 ml/L of a sulfated alkyl ethoxylate (TRITON™ QS-15). The acid electrolyte also includes residual iron in an amount of 0.5 g/L. Water is added to the electrolyte to provide a desired volume. The pH of the electrolyte is 1.

The steel coupon is wrapped around a conductive mandrel and rotated at a speed of 1400 rpm in the acid electrolyte at a temperature of 25° C. The coupon is then electroplated using a current density of 35 A/dm$^2$ to deposit a tin/indium film having a thickness of $5\times10^{-4}$ cm.

The steel coupon with the alloy deposit is then placed in a 15 wt % flux containing 5.25 g/L of tin, 0.75 g/L of indium, 7.5 g/L of sulfuric acid, 0.15 g/L of 5-sulfosalicylic acid, 0.15 g/L of the EO/PO copolymer, 1.5 m/L of the sulfated alkyl ethoxylate, and 0.075 g/L of iron. The coupon is removed from the flux after 10 seconds and air dried. The coupon is then conduction-reflow melted as in Example 1. The alloy is expected to be free of haze and blue stains.

EXAMPLE 12

Tin/Zinc Alloy and 10 wt % Flux

A 6 cm×15 cm steel coupon is plated with a tin/zinc alloy using an acid electrolyte which includes 20 g/L of tin from tin sulfate, 5 g/L of zinc from zinc sulfate, 60 g/L of sulfuric acid, 5 g/L of 5-sulfosalicylic acid, 0.5 g/L of an EO/PO copolymer with an average molecular weight of 1000, and 10 ml/L of a polyethoxylated amine (JEFFAMINE™ T-403). Water is added to the electrolyte to provide a desired volume. The pH of the electrolyte is less than 1.

The steel coupon is wrapped around a conductive mandrel and rotated at a speed of 2000 rpm in the acid electrolyte at a temperature of 25° C. The coupon is then electroplated using a current density of 15 A/dm$^2$ to deposit a tin/zinc film with a thickness of $1\times10^{-4}$ cm.

The steel coupon with the alloy film is then placed into a 10 wt % flux solution containing 2 g/L of tin, 0.5 g/L of zinc, 6 g/L of sulfuric acid, 5 g/L of 5-sulfosalicylic acid, 0.05 g/l of the EO/PO copolymer and 1 ml/L of the polyethoxylated amine. The coupon is removed after 5 seconds and air dried. The coupon is then conduction-reflow melted as in Example 1. The tin/zinc reflow is expected to be haze free and free of blue stains.

What is claimed is:

1. A method comprising:

a) passing an iron containing substrate into one or more electroplating cells containing a tin or tin alloy electrolyte, the tin or tin alloy electrolyte components comprise one or more sources of tin ions, 30 g/L to 120 g/L of sulfuric acid and 0.1 g/L to 10 g/L of sulfosalicylic acid, salts or isomers thereof;

b) electrodepositing a tin or tin alloy on the iron containing substrate in the one or more electroplating cells;

c) passing the iron containing substrate with the tin or tin alloy deposit from the electroplating cells into one or more dragout cells; and d) rinsing the iron containing substrate with the tin or tin alloy deposit in the one or more dragout cells with an electrolyte flowing counter-current to the iron containing substrate with the tin or tin alloy deposit, the electrolyte flowing counter-current contains concentrations of components at 5 wt % to 25 wt % of the components in the tin or tin alloy electrolyte in the one or more electroplating cells.

2. The method of claim 1, further comprising the steps of drying the iron containing substrate with the tin or tin-alloy deposit, and reflow melting the tin or tin-alloy deposit.

3. The method of claim 1, wherein the electrolyte flowing counter current further comprises one or more reducing agents, one or more surfactants, one or more grain refiners, one or more brighteners, one or more current density range extenders, one or more sludge agglomerants, one or more wetting agents, or mixtures thereof.

* * * * *